United States Patent [19]

Boutcher, Jr.

[11] Patent Number: 4,779,334

[45] Date of Patent: Oct. 25, 1988

[54] APPARATUS FOR INSERTING TERMINALS ON THE ENDS OF WIRES INTO CAVITIES IN AN ELECTRICAL CONNECTOR

[75] Inventor: Andrew G. Boutcher, Jr., Harrisburg, Pa.

[73] Assignee: AMP Incorporated, Harrisburg, Pa.

[21] Appl. No.: 154,745

[22] Filed: Feb. 10, 1988

[51] Int. Cl.[4] ..... H01R 43/00

[52] U.S. Cl. ..... 29/748; 29/759

[58] Field of Search ..... 29/748, 752, 753, 754, 29/759, 742, 564.1, 564.6, 564.8, 747

[56] References Cited

U.S. PATENT DOCUMENTS

| | | | |
|---|---|---|---|
| 3,062,390 | 11/1962 | Schwalm et al. . | |
| 3,094,349 | 6/1963 | Schwalm . | |
| 4,099,316 | 7/1978 | Morgan et al. . | |
| 4,171,566 | 10/1979 | Tominoi | 29/748 |
| 4,308,659 | 1/1982 | Brandewie et al. . | |
| 4,380,117 | 4/1983 | Brandewie et al. . | |
| 4,531,280 | 7/1985 | Bakermans . | |
| 4,653,160 | 3/1987 | Thorkildsen et al. . | |

*Primary Examiner*—Carl E. Hall

*Attorney, Agent, or Firm*—William B. Noll

[57] ABSTRACT

Terminal inserting apparatus comprises first and second sets of closable jaws, the second set of jaws being between the first set of jaws and the cavity in the connector into which the terminal is to be inserted. The jaws are normally aligned and are juxtaposed and are movable relative to each other to spaced-apart positions. In use, the first set of jaws is closed onto the wire adjacent to the end thereof and adjacent to the terminal. The second set of jaws is then moved towards the cavity and closed into surrounding and confining relationship with the terminal on the wire. The second set of jaws does not grip the wire so that the terminal can move relative thereto. The first set of jaws then moves towards the second set of jaws thereby moving the terminal, into the cavity. The actuating mechanism swings the jaws between a lead pick-up station and a lead insertion station.

20 Claims, 14 Drawing Sheets

APPARATUS FOR INSERTING TERMINALS ON THE ENDS OF WIRES INTO CAVITIES IN AN ELECTRICAL CONNECTOR

FIELD OF THE INVENTION

This invention relates to inserting apparatus, of the type commonly referred to as "block loaders", for inserting terminals on the ends of wires into the cavities of an electrical connector housing. Apparatus of this type is frequently used in conjunction with automatic or semi-automatic harness making machines.

BACKGROUND OF THE INVENTION

The manufacturer of electrical harnesses and harness subassemblies usually requires that terminals on the ends of electrical wires be inserted into the cavities of an electrical connector housing. The electrical connector may have a relatively large number of cavities for the reception of terminals and the cavities are frequently arranged in parallel rows and on closely spaced centers. The design of inserting machines of the type under consideration presents several wire handling and wire feeding problems which must be overcome, particularly if the machine is to be capable of being used under a variety of circumstances with different types of wires and terminals. For example, wires are inherently limp and the electrical lead (the wire having the terminal on the end thereof) must therefore be gripped during insertion very close to the terminal or perhaps on the terminal itself. A further problem arises as a result of the close spacing of the cavities in the connector housing. It is difficult to design parts with adequate clearance to permit the insertion of terminals into cavities which have adjacent cavities that have already received terminals because of the presence of the wires extending from the previously inserted terminals. The guidance of the terminal when it is inserted into the cavity presents difficult design problems and may result in the provision of a machine which is useful only under limited circumstances.

The present invention is directed to the achievement of a terminal inserter which is capable of being used with a wide variety of harness making machines and under a wide variety of circumstances as regards the types of connectors into which the terminals are inserted and the manner in which the electrical leads are delivered to the inserter. The invention is further directed to the achievement of an inserter which is versatile with regard to the types of terminals and connector housings with which it is used.

THE INVENTION

In accordance with one aspect thereof, the invention comprises a terminal inserting means for inserting an electrical terminal into a terminal receiving cavity in an electrical connector housing. The housing has a terminal receiving face and the cavity extends inwardly from the terminal receiving face. The terminal inserting means is characterized in that it comprises terminal aligning means for aligning the terminal with the cavity and a terminal inserter for moving the terminal into the cavity. The terminal inserter comprises a first set of jaws and the terminal aligning means comprises a second set of jaws, the first and second sets of jaws being normally open and being normally in aligned side-by-side juxtaposed positions. The seond set of jaws is between the first set of jaws and the cavity into which the terminal is to be inserted. The first and second sets of jaws are movable between their juxtaposed positions and extended positions in which the jaws are in aligned, spaced-apart relationship. The first and second sets of jaws are closable upon a lead located between the jaws of each set of jaws, the first set of jaws being in gripping engagement with the lead in their closed positions and the second set of jaws being in surrounding but non-gripping relationship with the terminal when in their closed positions. Actuating means are provided for closing the first and second sets of jaws, moving the second set of jaws to their extended position, and thereafter moving the first set of jaws relatively towards the second set of jaws and relatively towards the connector housing whereby upon placing a lead between the jaws and placing a connector housing adjacent to the lead with the cavity in approximate alignment with the lead, and upon closing the first and second sets of jaws and moving the second set of jaws to the extended position, the terminal will be surrounded by the second set of jaws and precisely aligned with the cavity. Upon thereafter moving the first set of jaws relatively towards the second set of jaws and relatively towards the connector housing, the terminal will be inserted into the cavity, the second set of jaws serving as a terminal guide during insertion.

In accordance with further embodiments, the actuating means moves the first set of jaws towards the second set of jaws and towards the connector housing during insertion of the terminal into the cavity. Alternatively, the actuating means may move the connector housing towards the first set of jaws during insertion of the terminal into the cavity.

Electrical terminals are frequently provided with a retaining lance which engages a retaining shoulder in the connector housing cavity thereby to prevent movement of the terminal from the cavity after insertion. In accordance with a further embodiment, the actuating means has means for moving the connector housing and the first set of jaws relatively away from each other after insertion of the terminal thereby positively to engage the retaining lance with the shoulder and ensure complete insertion of the terminal into the cavity. A sensing means is provided for sensing complete insertion of the terminal into the cavity.

THE DRAWING FIGURES

FIGS. 1–8 present a series of diagrammatic views which show some of the essential elements of the apparatus and illustrate the movements thereof during an operating cycle in which a terminal on the end of a wire is inserted into a cavity in a connector housing.

THE DISCLOSED EMBODIMENT

Figure 1:
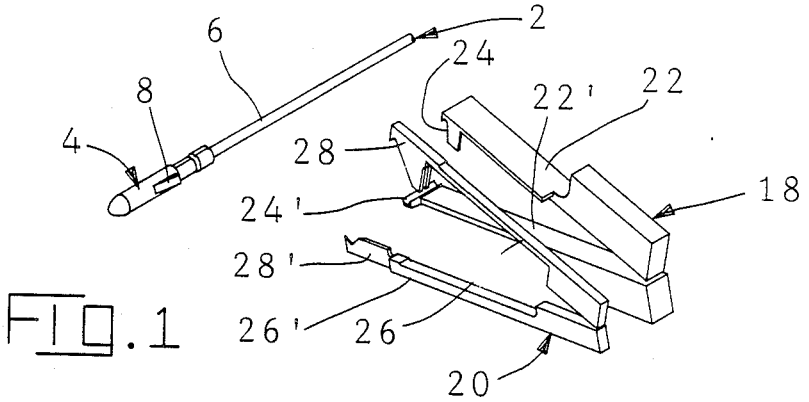
Figure 2:
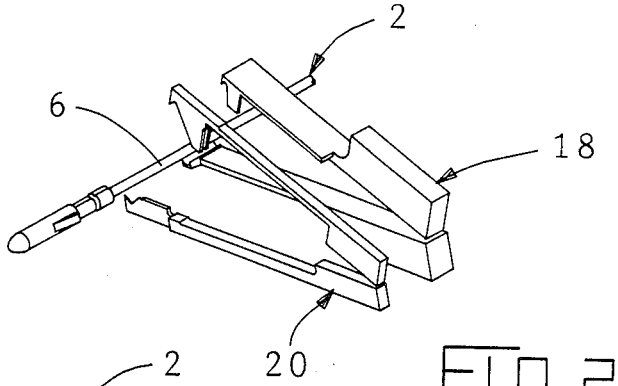

FIGS. 1–8 illustrate an operating cycle of the apparatus during which an electrical lead 2 having a terminal 4 on its end is inserted into a cavity 14 extending inwardly in the terminal receiving face 12 of an electrical connector housing 10. The terminal is crimped onto one end of a wire 6 and has a retaining lance 8 extending therefrom intermediate its ends. The retaining lance engages a retaining shoulder 16 in the cavity thereby to retain the terminal after insertion.

The apparatus comprises generally first and second sets of jaws 18, 20. The jaws 18 serve to grip the lead adjacent to the terminal while it is pushed into the cavity in the housing. The jaws 20 surround the end portion of the terminal, as will be described below, and guide the terminal into the housing during insertion. The jaws 18 comprise arms 22, 22′ having wire gripping surfaces 24, 24′ on their ends. The second set of jaws 20 comprises arms 26, 26′ having end portions 28, 28′ which surround the terminal and permit movement therethrough when these jaws are closed.

Figure 3:
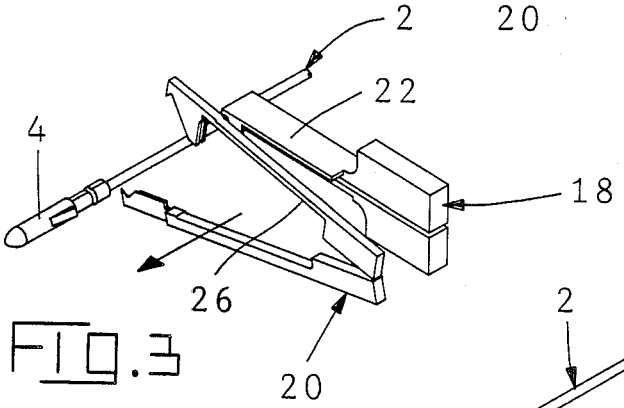
Figure 6:
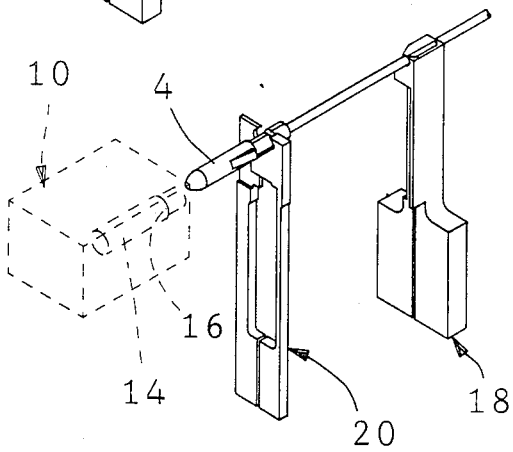
Figure 7:
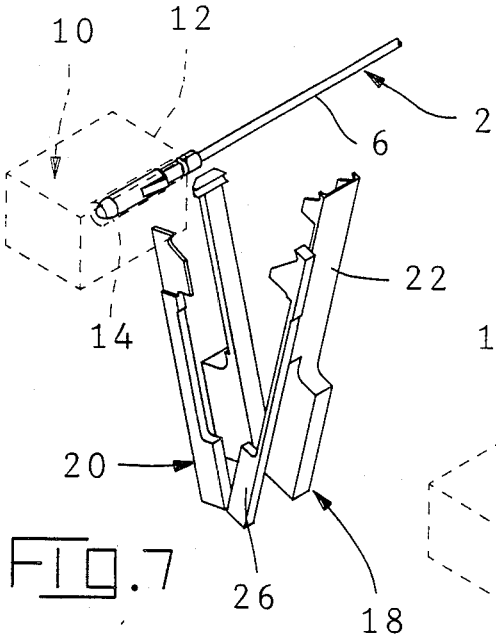
Figure 8:
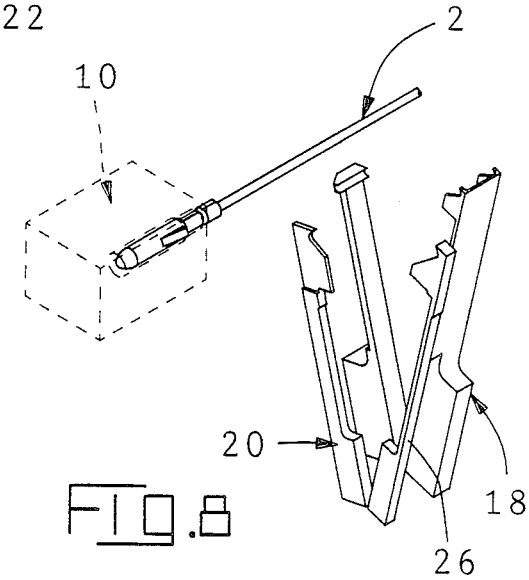

At the beginning of an operating cycle, the electrical lead 2 will have been delivered to a lead-receiving zone and the two sets of jaws will be positioned as shown in FIG. 1; that is slightly to the right of the lead 2 with the jaws in their open positions. Initially, both sets of jaws, which are juxtaposed at this stage of the operating cycle, move leftwardly to the position of FIG. 2 so that they will surround or engage the lead when they are closed. The first set 18 of jaws is then closed onto the wire as shown in FIG. 3. The second set of jaws is then moved in the direction of the arrow from the position of FIG. 3 to the position of FIG. 4 and these jaws are closed during such movement so that when the second set of jaws have arrived in the position of FIG. 4, the leading end of the terminal 4 will be surrounded and confined by the ends 28, 28′ of the jaws 20. Thereafter, both sets of arms are swung in a clockwise direction to the position of FIG. 5 in which the terminal 4 is in substantial alignment with the cavity 14 in the connector 10. Both sets of jaws then move a short distance in unison leftwardly from the position of FIG. 5 the position of FIG. 6 to bring the leading end of the terminal immediately adjacent to the entrance to the cavity 14. Thereafter, the first set of jaws 18 is moved relatively towards the second set of jaws thereby to insert the terminal into the cavity until the lance 8 has moved past a retaining shoulder 16 in the cavity. After insertion has been accomplished, the connector housing and the first set of jaws are moved relatively apart a short distance to bring the lance against the shoulder 16. This ensures that the terminal is fully inserted. When this movement of the lance against the shoulder is sensed by a sensing means, both sets of jaws are opened, thereby to release the electrical lead. The two sets of jaws then move downwardly as shown in FIG. 7 and move rearwardly as shown in FIG. 8. Thereafter, the jaws are swung through a counterclockwise arc of about 90 degrees to bring them to the starting position of FIG. 1.

In the foregoing description, it is stated that the first set of jaws 18 is moved relatively towards the second set of jaws 20 to bring about insertion of the terminal 4 into the cavity 14. This relative movement can be brought about either by moving the first set of jaws towards the second set of jaws and towards the housing or by moving the housing towards the first and second set of jaws; that is by moving the housing rightwardly from the position of FIG. 6 and thereby moving the housing onto the terminal. During such movement of the housing, the second set of jaws 20 will be pushed by the housing back towards the first set of jaws 18 until both sets of jaws are again juxtaposed as shown in FIG. 7. The rightward movement of the housing can be accomplished by a conventional robot which grips the housing and moves it from the position of FIG. 6 to the position of FIG. 7. The specific embodiment of the invention described below does rely on the robot to effect this movement of the terminal into the housing. If desired however, the second set of jaws can be moved during the terminal insertion step and the housing can remain stationary.

Any one of a number of commercially available robots can be used with the apparatus 30 shown in the drawing. Good results have been obtained using a Pana Robo made by Matsushita Electric, Model MG6620. This model is a four-axis scara-type robot. In practice, the robot would be placed to the left of the apparatus as viewed in FIGS. 10–12 and the arm 178 and grippers 180 are shown in FIG. 12. The robot would be programmed to pick up the housing 10 from a bin or the like and transport it to the position shown in FIG. 12. The robot would also be programmed to index the housing 10 after each insertion cycle and position an empty cavity in position for insertion of a terminal during the next operating cycle. After all of the cavities in a housing had been filled, the robot would carry the housing to a discharge station and deposit it in a suitable receptacle or transfer it to a further handling apparatus.

Figure 4:
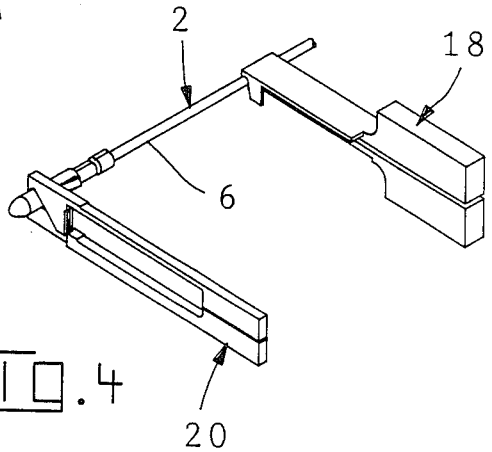
Figure 5:
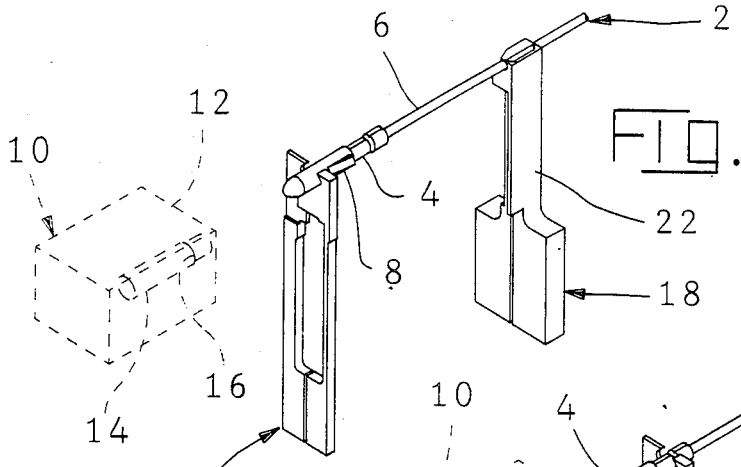
Figure 9:
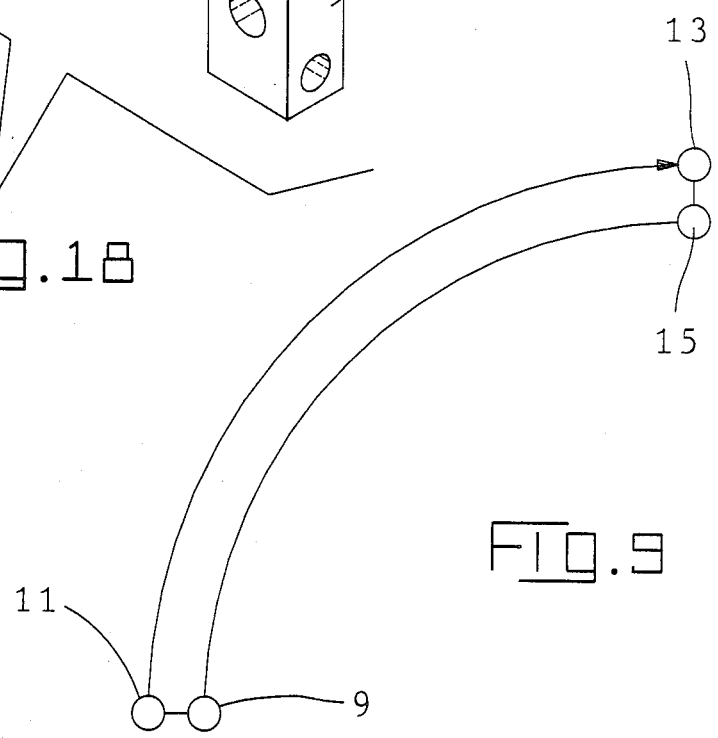
FIG. 9 is an indicator diagram of the path followed during an operation cycle.

FIG. 9 is an indicator diagram which illustrates the movement of the sets of jaws during an operating cycle. The diagram does not indicate the movements of the jaws relatively away from and back towards each other as shown in FIGS. 3 and 4. The lines shown in FIG. 9 can be taken to indicate the movement of the pivot point of the second set of jaws 20 although it does not show the movement of this point away from the first set of jaws. At the beginning of the operating cycle, this pivot point will be in position 9 and will move leftwardly along line 9–11 when the jaws are moved to the position of FIG. 2. The arcuate movement of both sets of jaws from the position of FIG. 4 to the position of FIG. 5 is indicated by the arcuate line 11–13. The downward movement of both sets of jaws (FIGS. 6 and 7) is indicated by the line 13–15 and the return movement to the position of FIG. 1 is indicated by the line 15–9.

Figure 10:
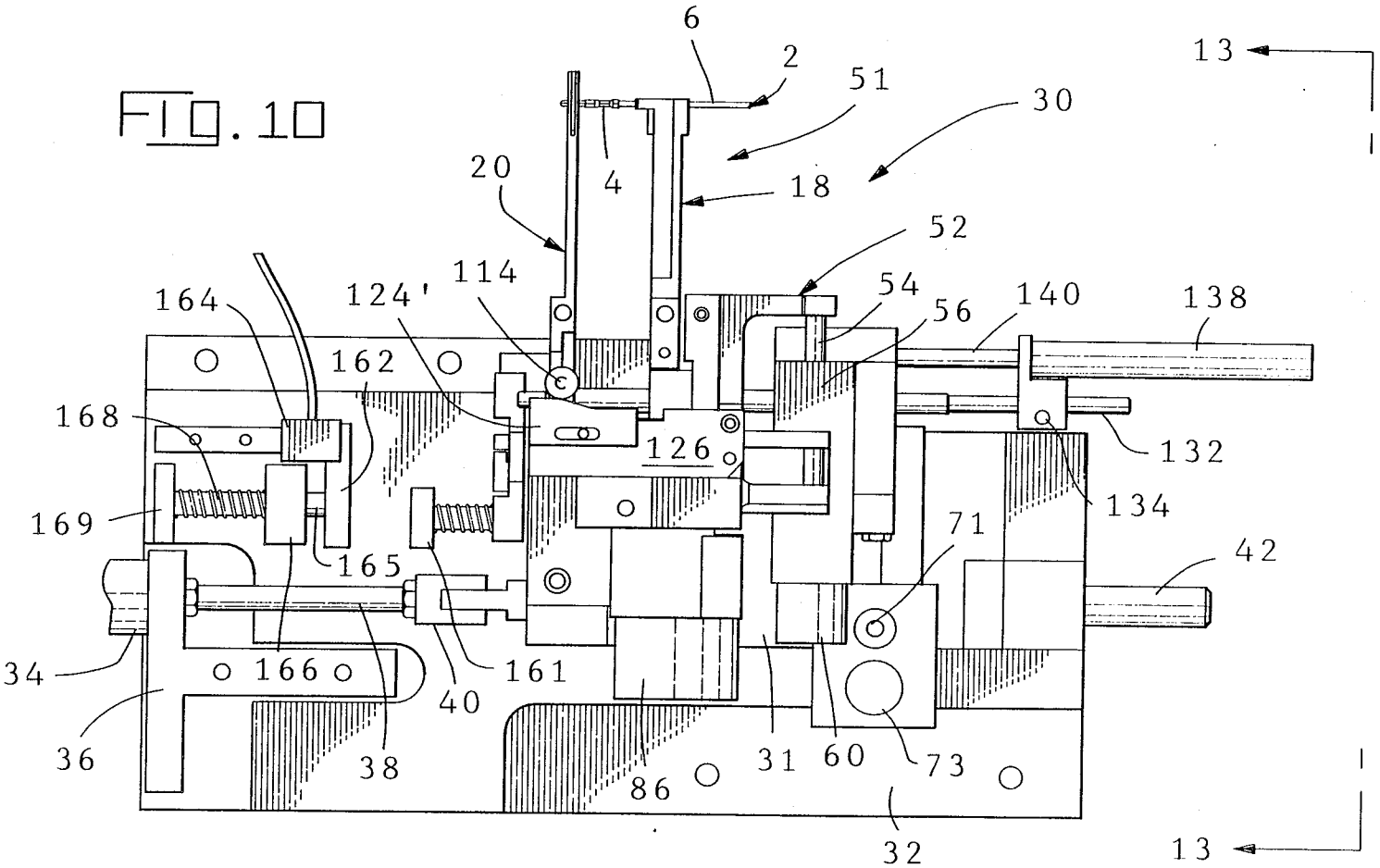
FIG. 10 is a top plan view of the apparatus, this view showing the positions of the parts illustrated diagrammatically in FIG. 4.
Figure 11:
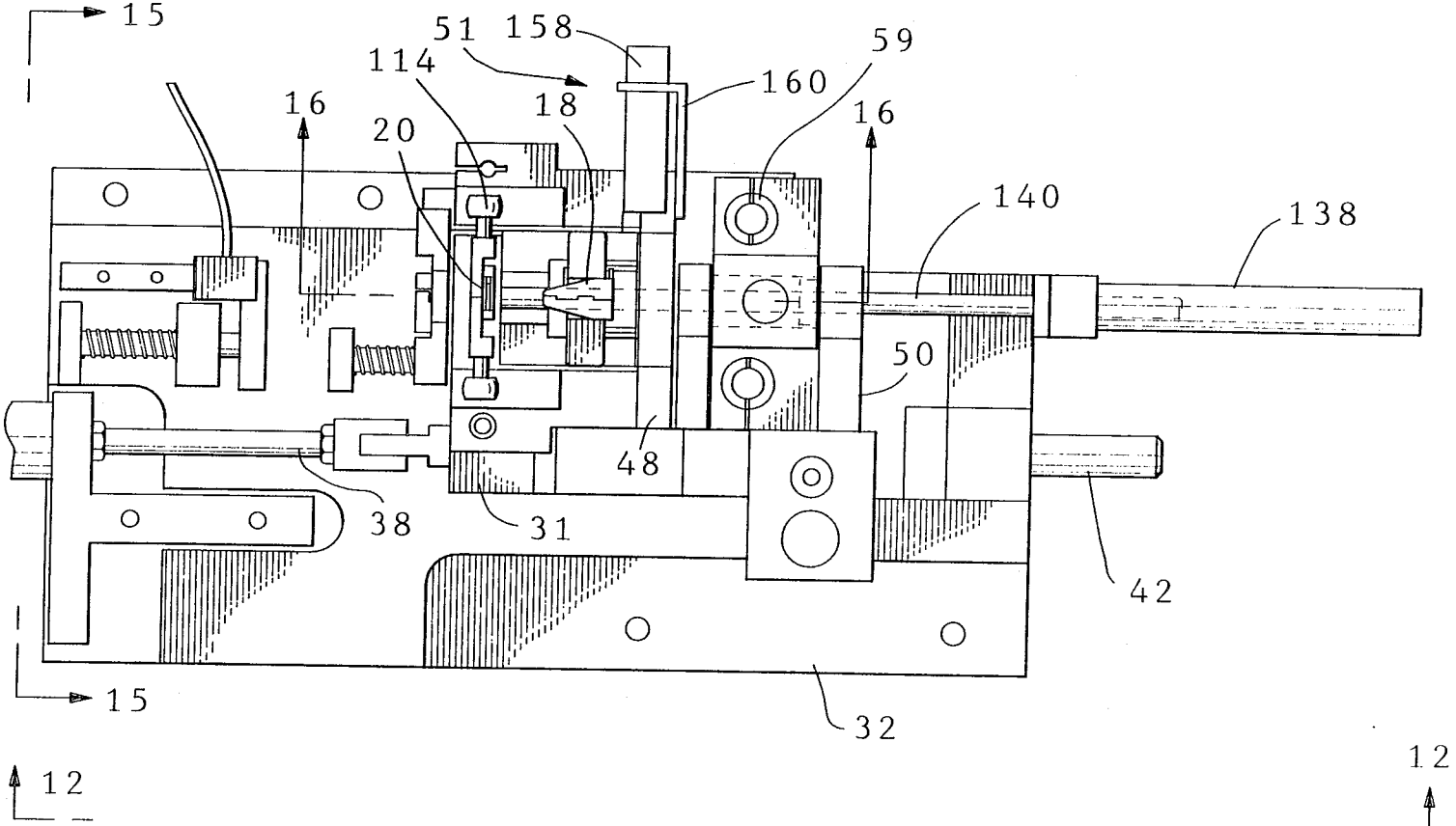
FIG. 11 is a top plan view showing the parts in the positions of FIG. 5.
Figure 12:
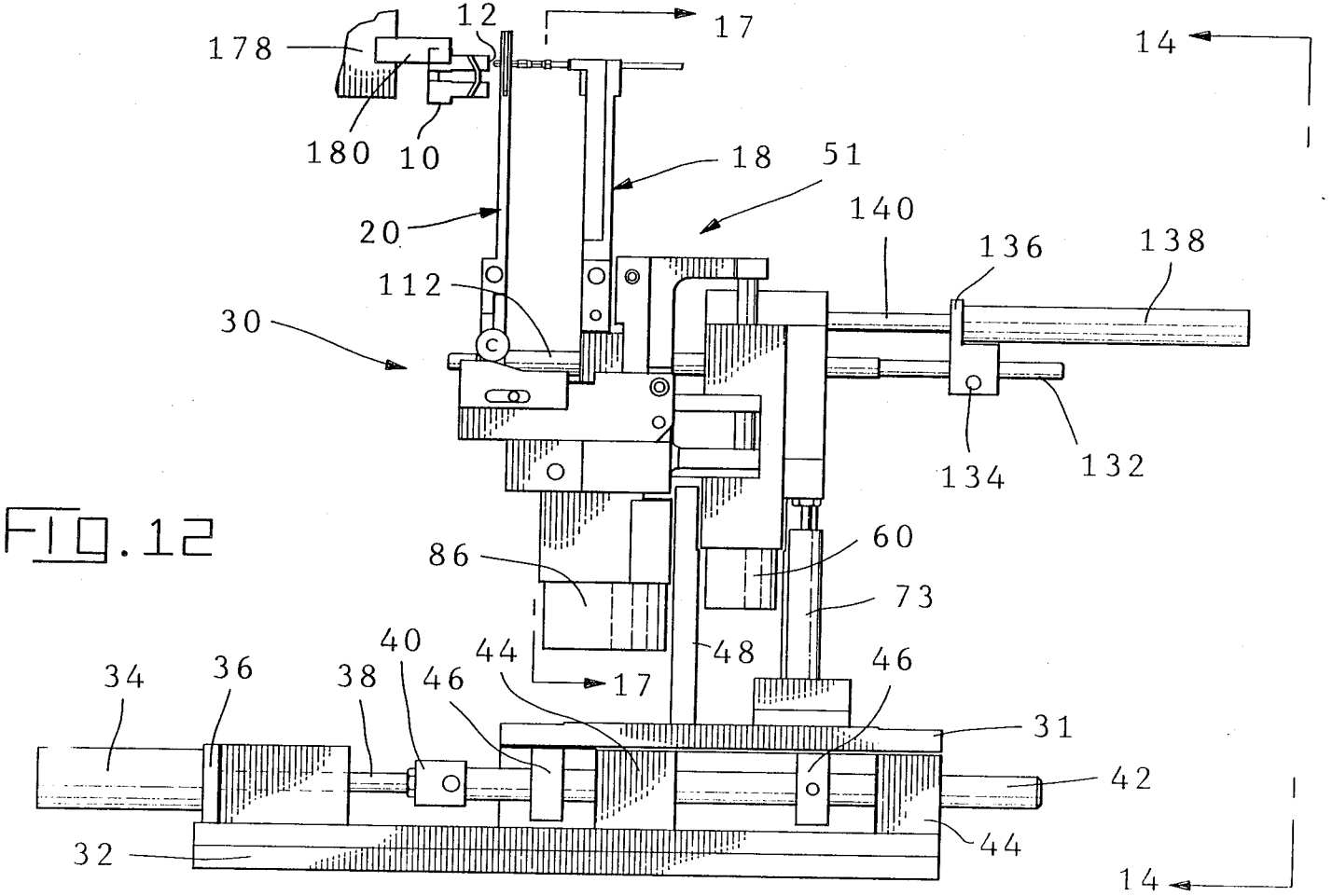
FIG. 12 is a side view looking in the direction of the arrows 12—12 of FIG. 11.

The disclosed embodiment of the apparatus 30, FIGS. 10–12, comprises a jaw assembly 51 which is mounted on a fixed base plate assembly 32 and is supported by a movable support plate 31 which is above the base plate and movable with respect thereto. The support plate 31 is movable in order to move both sets of jaws after they are in alignment with the cavity in the connector towards the connector, thereby to bring the leading end of the terminal adjacent to the cavity 14 as shown in FIGS. 5 and 6. Such movement of support plate 31 is brought about by a piston cylinder 34 which is mounted on the base plate 32 by a bracket 36 as shown in FIG. 12. The piston rod 38 which extends from the cylinder is coupled by a coupling 40 to a control rod 42. This control rod extends through bearings 44 fixed to the base plate 32 and through bearing surfaces in ears 46 which are secured to the underside of the support plate 31. The control rod is pinned or otherwise secured to at least one of these ears 46 so that the support plate 31 will be moved.

Figure 16:
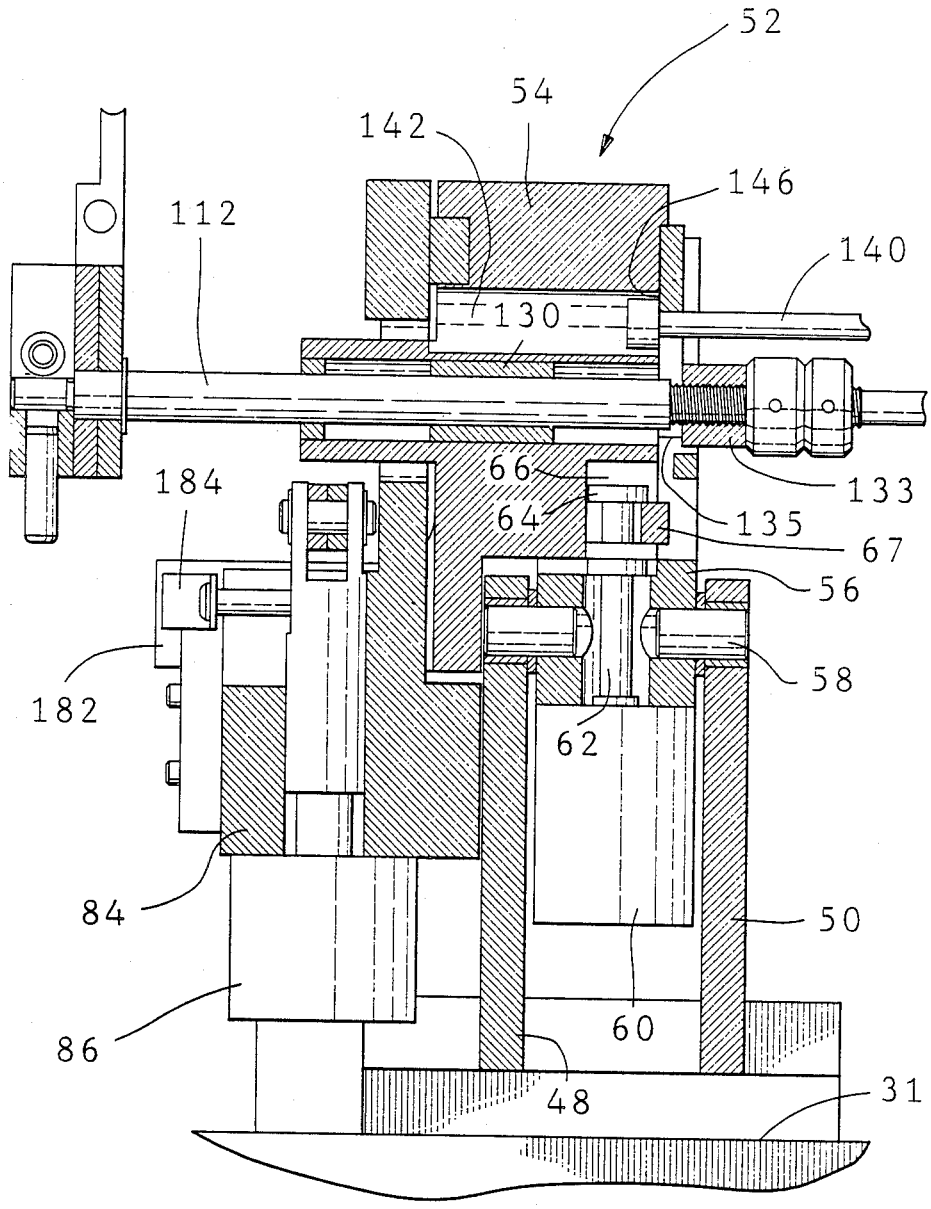
FIG. 16 is a sectional view looking in the direction of the arrows 16—16 of FIG. 11.

A pair of spaced-apart vertical support plates 48, 50 (FIGS. 12 and 14) extend upwardly from the upper surface of support plate 31 and the supporting and actuating assembly 52 (FIG. 16) for the first and second sets of jaws 18, 20 is supported by vertical plates 48, 50. This assembly comprises a main mounting block 54 which is carried by a trunnion block 56 which is between the opposed surfaces of the vertical plates 48, 50. The trunnion block 56 has gudgeons 58 which are rotatably supported by suitable bearings in the vertical plates as shown in FIG. 16. On its lower side in FIG. 16, a piston cylinder 60 is secured to the trunnion block 56 and the piston rod 62 of this cylinder is secured as shown at 64, 66 and by a retaining key 67 to the mounting block 54. This piston cylinder 60 provides the motion of the mounting block 54 and the two sets of arms indicated in FIGS. 1 and 2, and in FIGS. 6 and 7, that is, the leftward movement shown in FIGS. 1 and 2 and the downward movement shown in FIGS. 6 and 7. It will be apparent that this motion is controlled by the piston rod 62. The block 54 is guided during movement by guide rods 59 (FIG. 20) which extend through block 56.

Figure 13:
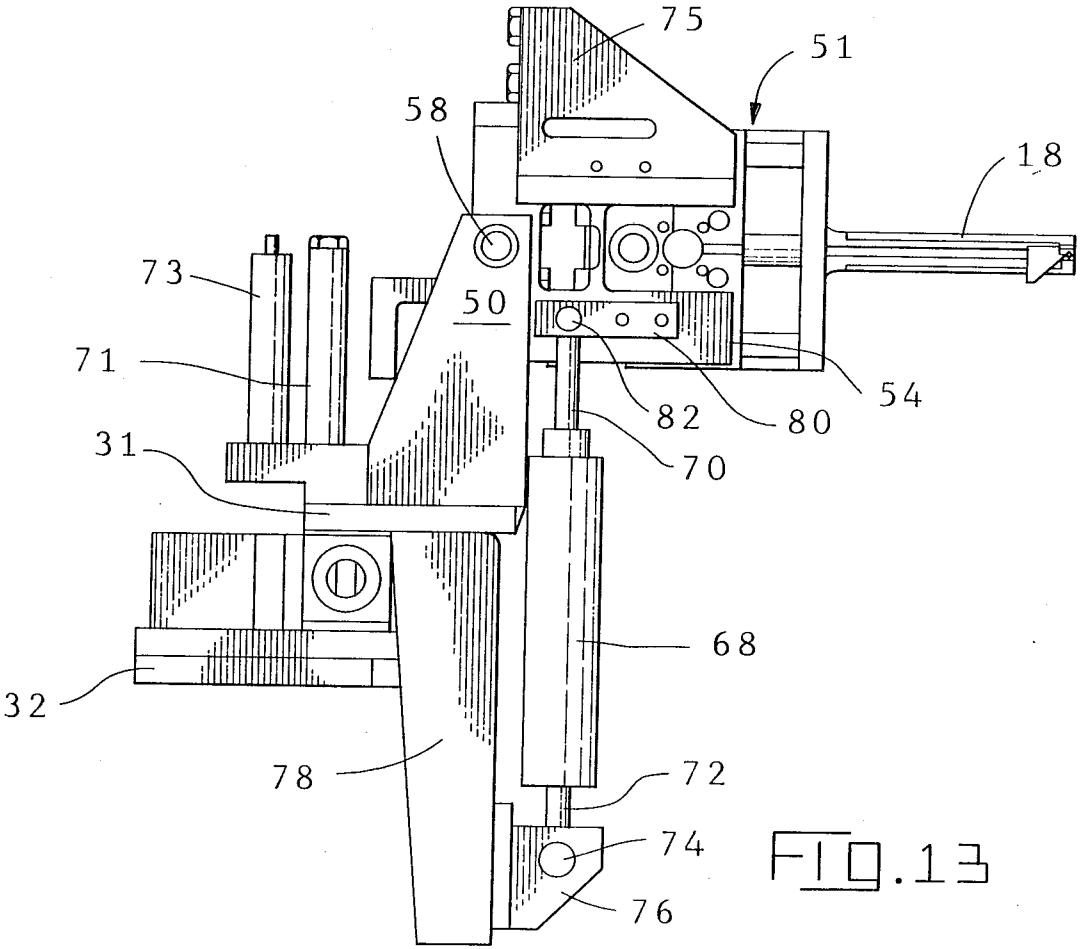
FIG. 13 is an end view looking in the direction of the arrows 13—13 of FIG. 10.
Figure 14:
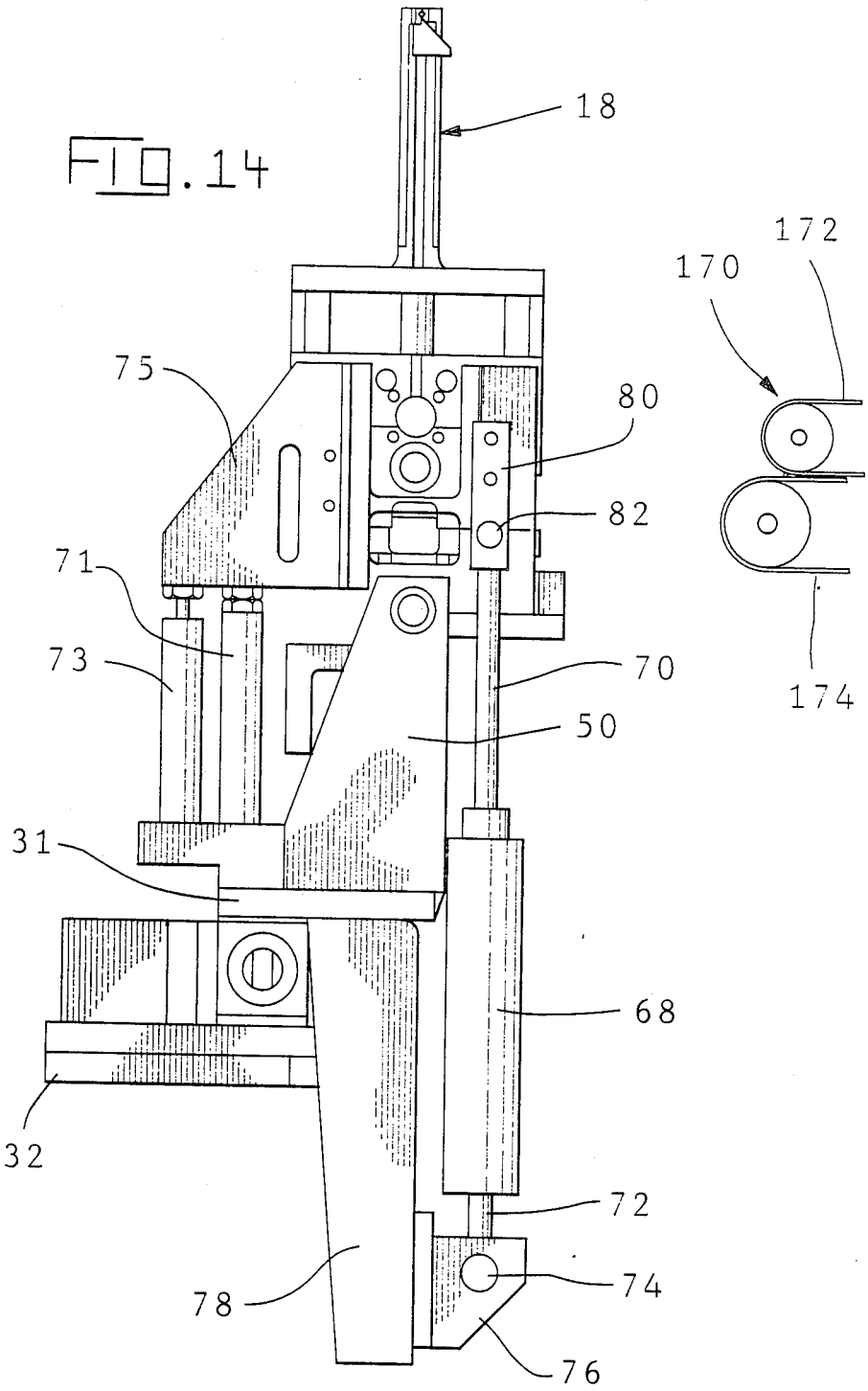
FIG. 14 is an end view looking in the direction of the arrows 14—14 of FIG. 12.
Figure 15:
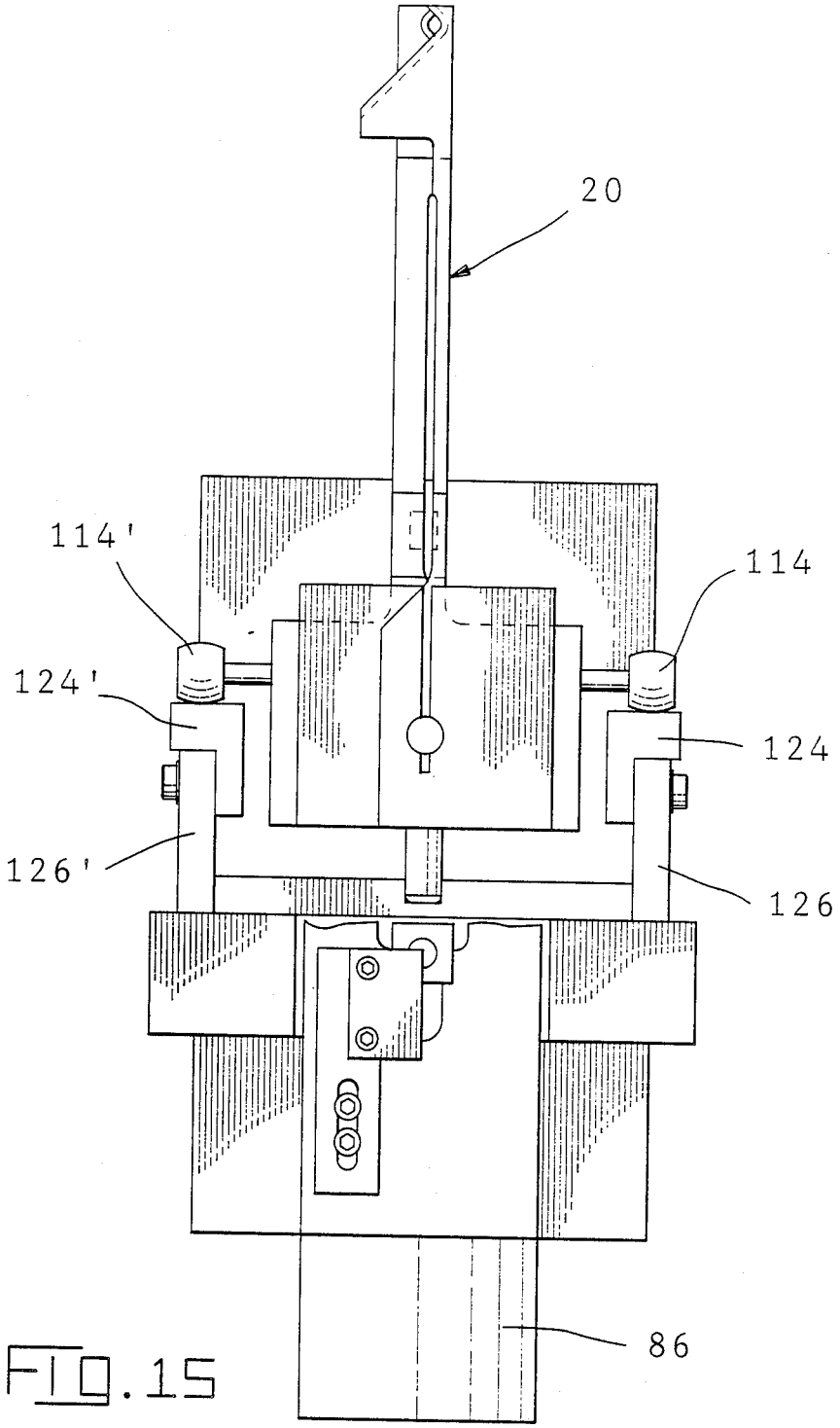
FIG. 15 is an end view looking in the direction of the arrows 15—15 of FIG. 11.

The pivoting motion of the jaws from the position of FIG. 4 to the position of FIG. 5 and from the position of FIG. 8 to the position of FIG. 1 is brought about by a piston cylinder 68 (FIGS. 13 and 14) which extends beslde the vertical support plate 50 and downwardly past the horizontal support plate 31. The piston rod 70 which extends from cylinder 68 extends upwardly as viewed in FIG. 14 and is pivotally connected at 82 to a coupling block 80 which is secured to block 54. At its lower end, the cylinder 68 has a mounting rod secured thereto which is pivotally supported at 74 between ears 76 which extend from the bracket 78. Movement of the piston which is within the cylinder 68 thus causes arcuate movement of the mounting block 54 between the positions of FIGS. 13 and 14, thus moving the two sets of jaws between their two positions. It is desirable to provide a stop 71 and a shock absorber or dash pot 73 for the trunnion block 56 as shown in FIG. 14. The stop determines the vertical position of the trunnion block and the shock absorber prevents the trunnion block from being moved abruptly against the stop. The shock absorber and the stop are supported on plate 31 as shown in FIG. 14 and are engaged by an ear 75 which extends from the trunnion block 56.

Figure 18:
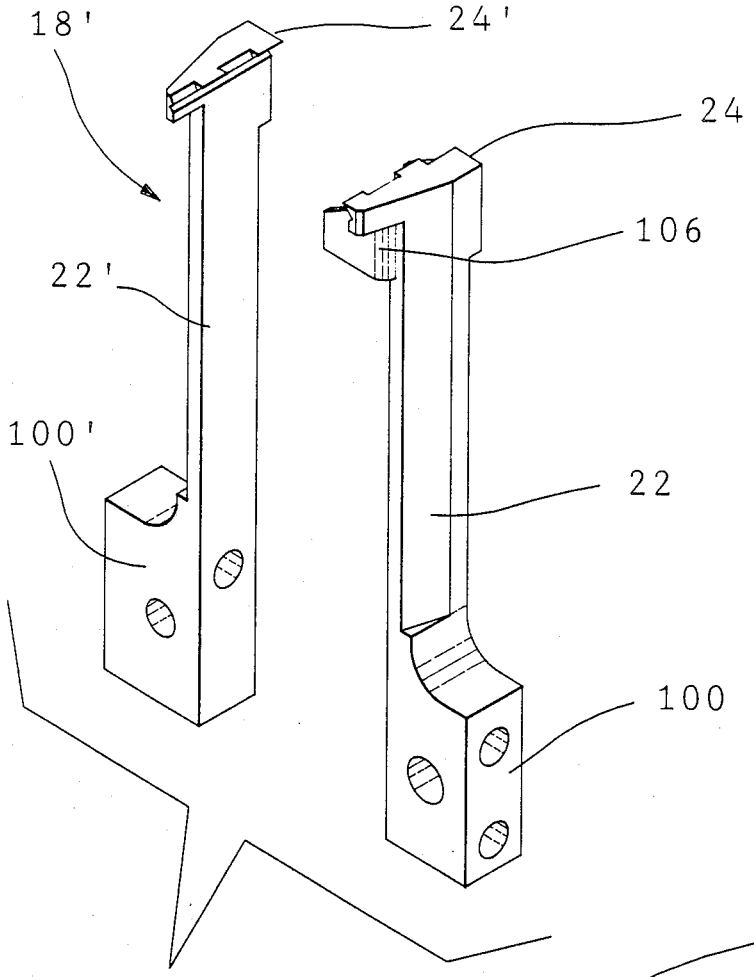
FIG. 18 is a fragmentary exploded view showing the first set of jaws which grip the wire adjacent to the lead.
Figure 17:
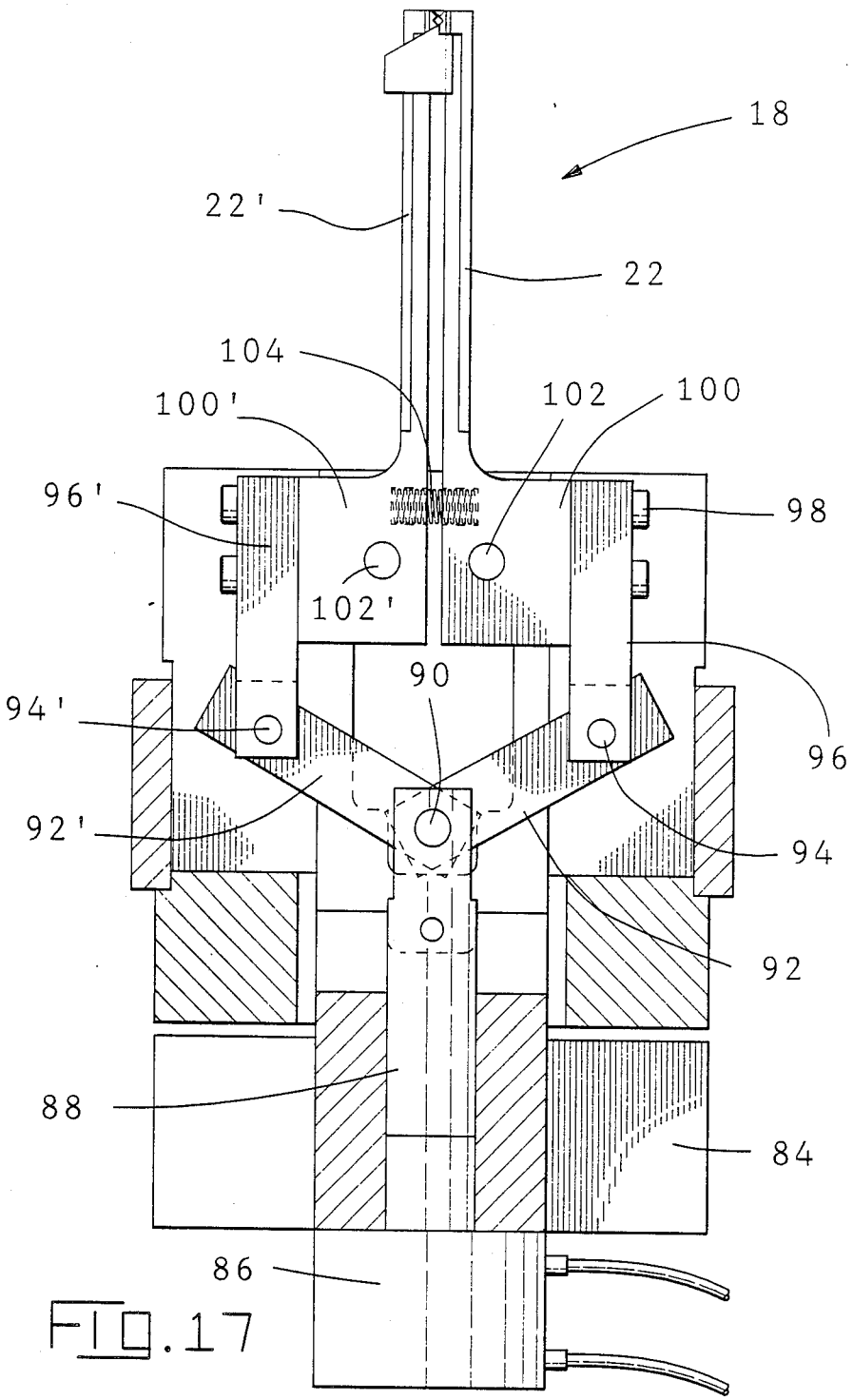
FIG. 17 is a view looking in the direction of the arrows 17—17 of FIG. 12 but showing the first set of jaws in their open position rather than their closed positions.
Figure 20:
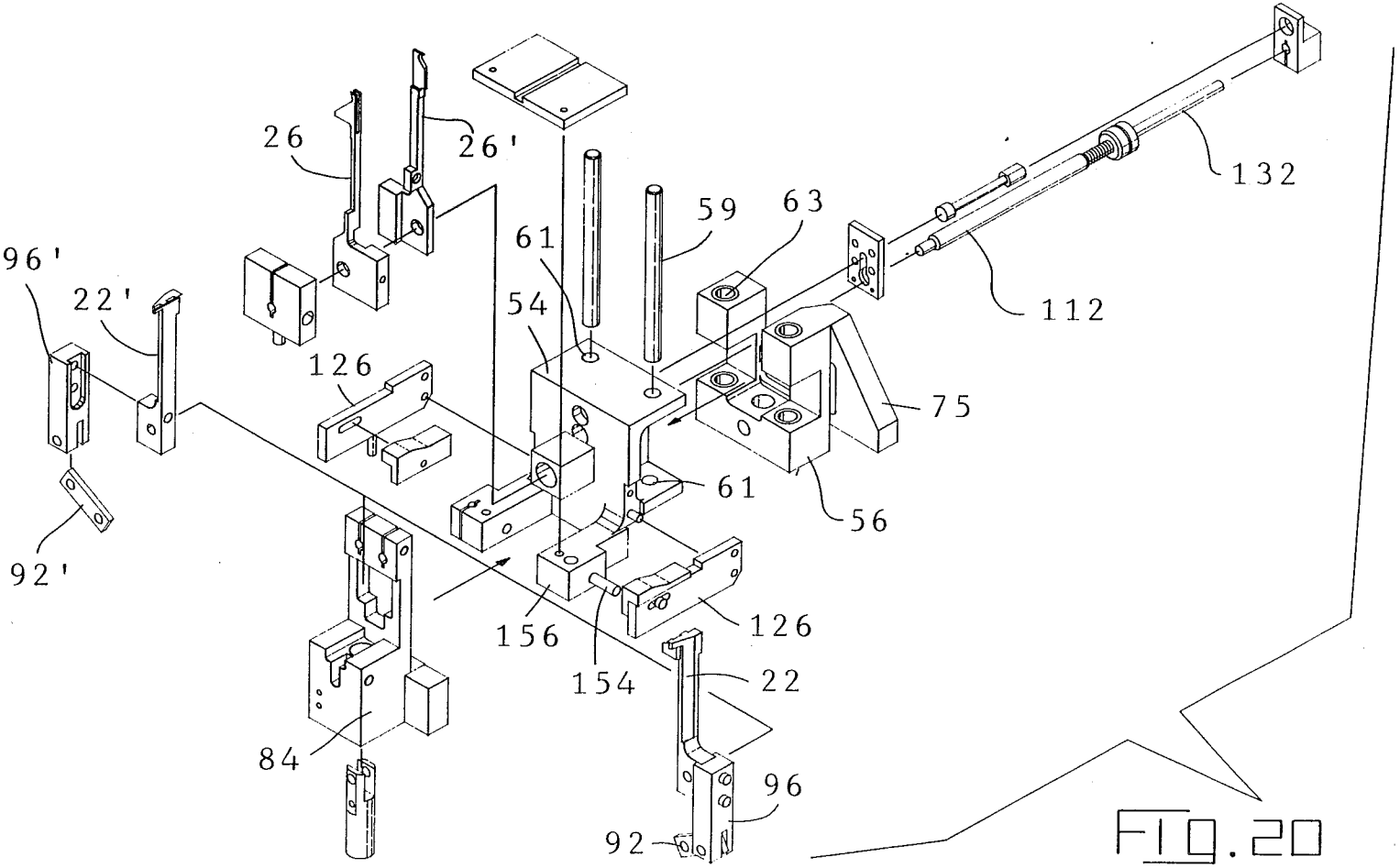
FIG. 20 is an exploded perspective view showing the principal parts of the apparatus.

Referring now to FIGS. 17, 18, and 20, the arms 22, 22' of the first set of jaws 18 have enlarged lower ends 100, 100' which are pivotally mounted on spaced-apart pivotal axes 102, 102' on a jaw mounting block 84. Extension blocks 96, 96' are secured to the outwardly facing ends of the enlarged portions 100, 100' of the arms by fasteners 98 and the lower ends of these extensions 96 are pivoted at 94, 94' to toggle links 92, 92'. The toggle links in turn are commonly connected on a pivotal axis 90 to a control rod 88 which can be moved upwardly from the position shown in FIG. 17 by a piston cylinder 86. Such upward movement of the pivotal axis 90 will cause the ends of the arms 22, 22' to close onto each other and grip the wires. During closure, a relatively stiff spring 104, which is between the arms, is compressed. As will be explained below, the first set of jaws 18 are opened by this spring rather than by movement of the control rod 88.

As can be seen in FIG. 18, the ends of the arms 22, 22' are contoured to grip the wire tightly adjacent to the terminal and the arm 22 in addition has a gathering ear 106 which guides the wire into a receiving recess means in the opposed surfaces of the arms.

In order to permit the pull test, which is described above, to be carried out, the block 84, on which the jaws 18 are carried, is pivotally mounted on a pivot pin 154 which extends through block 84 and through arms 156 which extend through spaced apart arms 156 on the block 54. The block 84 is resiliently biased to the position shown in FIG. 12 but can be swung through a slight counterclockwise arc from the position shown in FIG. 12. The pull test is carried out by moving the housing away from the jaws 18 so that when the lance on the terminal engages the shoulder in the cavity, the housing will pull the wire and the jaws leftwardly in FIG. 12 and the jaws 18 and the block will be swung through a slight arc. The movement of the jaws is detected by a Hall effect sensor 158 (FIG. 11) which is supported by a bracket 160 mounted on block 54. The sensor then sends a signal to the cause the piston cylinder 86 to be exhausted and the jaws 18 are opened and the wire is released.

Figure 19:
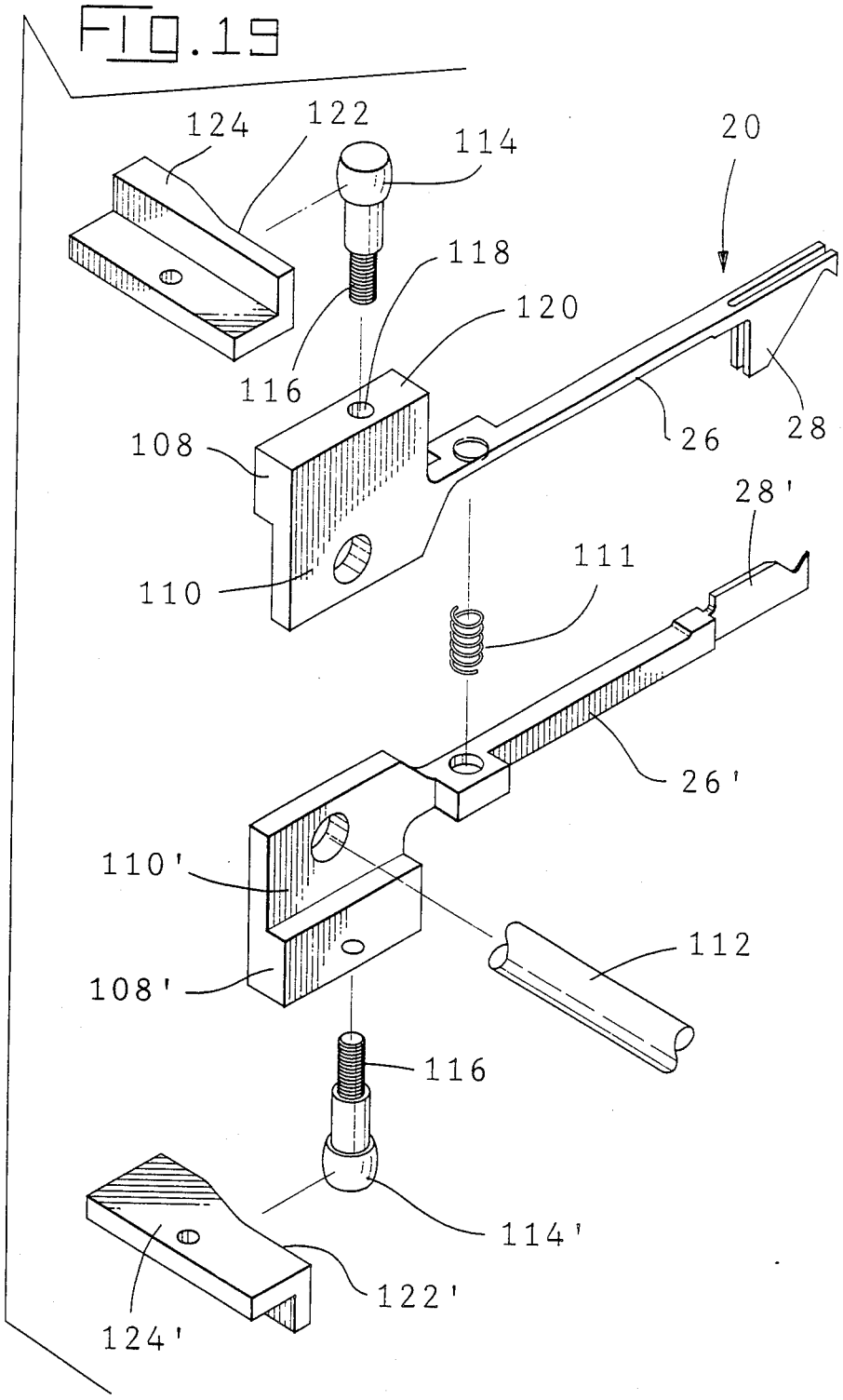
FIG. 19 is a fragmentary exploded view showing the second set of jaws.

The arms 26, 26' of the second set of jaws 20 (FIG. 19) also have ends 28, 28' which are formed in a manner such that they will surround the wire, even if it is not perfectly positioned at the outset of the operating cycle, and center it between opposed notches in the ends of the arms. The arm 26' comprises a relatively thin section which is dimensioned to enter a slot in the relatively wider end portion of the arm 26 to facilitate the gathering of the terminal or location of the terminal.

The lower ends 108,108' of the arms 26, 26' are enlarged and are recessed as shown at 110, 110' so that they can overlap each other. The dimensions are such that the arms can be pivoted towards and away from each other on a pivotal axis 112. A spring 111 is also provided to bias the arms apart.

The opening and closing of the second set of jaws is accomplished by means of cam rollers 114, 114' and fixed cams 124, 124'. The cam followers or cam rollers 114 are mounted on pins which are threaded as shown at 116 into threaded openings 118 in the outwardly facing edge surfaces 120 of the enlarged lower ends 108, 108'. The cam blocks 124, 124' have camming surfaces 122,122' which are contoured such that as the followers 114, 114' move over these surfaces, from right to left in FIG. 10, the arms will arcuately be swung towards each other and the jaws thereby closed. The cam blocks 124, 124' are supported on the block 54 by supports 126 and are not movable with respect thereto. Therefore, the entire second set of jaws 20, which are also part of the supporting and actuating assembly 52, must move relatively over these camming surfaces rightwardly and leftwardly. This movement also brings about the movement of the second set of jaws away from and towards the first set of jaws as shown in FIG. 3 and FIG. 8.

The relative movement of the second set of jaws is accomplished by the control rod 112 which is secured at its end to the jaws and which acts as a pivotal support for the jaws. This control rod extends through suitable bearings 130 (FIG. 16) in block 54 and has a right-hand end 132 as viewed in FIG. 21, which extends beyond the vertical support plate 50. The end portion 132 is clamped as shown at 134 to a bracket 136 which is secured to the cylinder 138 of a piston-cylinder assembly. This cylinder 138 and the piston 139 which is within the cylinder are both movable during the operating cycle. The piston rod 140 extends from the cylinder head into a cylindrical cavity 142 in the frame block 54 and has an enlarged stop 144 on its end. The cavity 142 has an end wall 146 which limits the movement of the piston rod 140. The operating cycle for the actuating system shown in FIGS. 21–25 is as follows.

Figure 21:
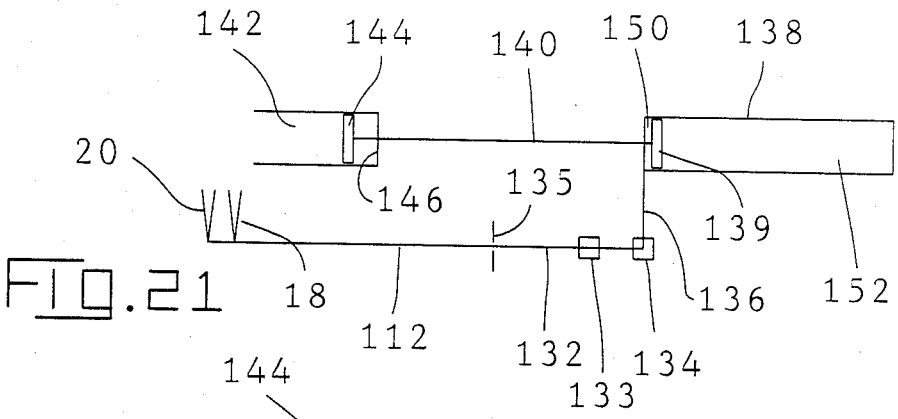
FIGS. 21–25 are diagrammatic views which illustrate the operation of pneumatic system which controls the movement of the jaws towards and away from each other.
Figure 22:
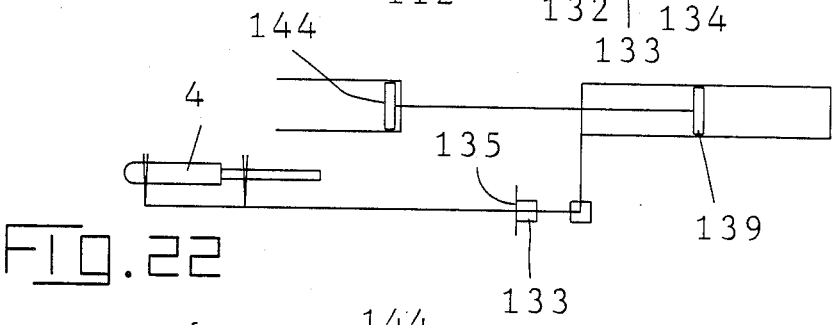
Figure 23:
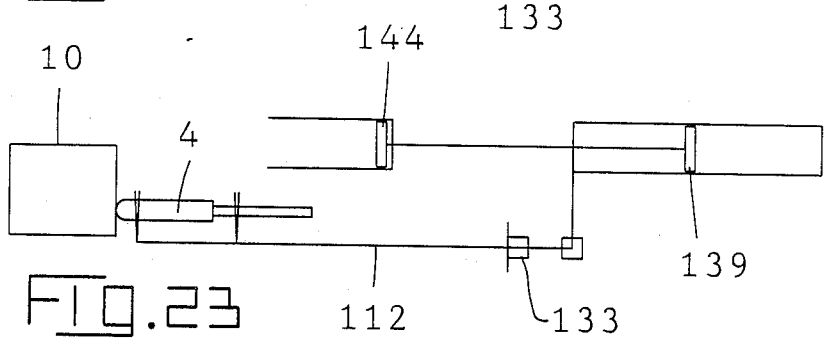
Figure 24:
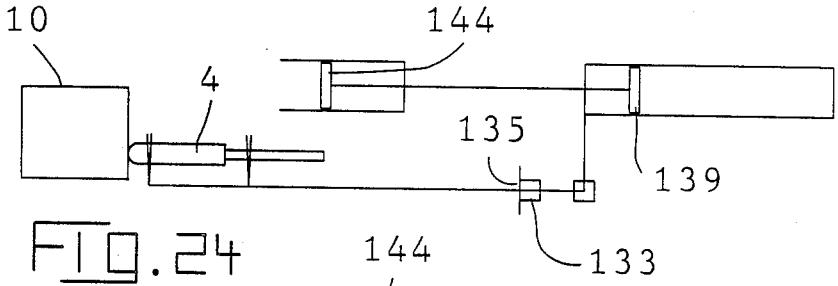

FIG. 21 shows the positions of the parts at the beginning of the cycle. Both sets of jaws are open and the jaws 20 are in the retracted positions against the jaws 18. The jaws 20 are moved to their extended positions as shown in FIG. 22 by pressurizing the cylinder 138 on the left-hand side 150 of the piston 139. Initially upon pressurizing the side 150 of the piston 139, the piston moves rightwardly until stop 144 is against endwall 146. Since the piston 139 cannot move further rightwardly, the cylinder 138 is forced to move leftwardly to the position of FIG. 22. This movement of the cylinder 138 and the rod 112,132 is limited by a stop member 133 on the rod which engages a fixed stop 135 as shown in FIGS. 16 and 22. During such movement of the cylinder, the jaws 20 are closed into surrounding and guiding relationship with the terminal 4 by camming surfaces 122,122'. Also during this portion of the cycle, the jaws 18 are closed and grip the wire, closure of the jaws 18 being brought about by the piston cylinder 86 as previously explained and as shown in FIG. 17. The entire assembly is then swung through a 90 degree arc as shown in FIGS. 4 and 5. The assembly is then moved leftwardly by piston-cylinders 34 (FIG. 12) so that the leading end of the terminal 4 is located adjacent to the face of the housing 10 and is in alignment with the cavity in the housing as shown in FIG. 23. Thereafter, the cylinder 138 is pressurized on the right hand side 152 of the piston 139 and the piston is moved leftwardly to the position of FIG. 24 thereby moving the stop 144 away from the endwall 146. The robot then moves the housing 10 rightwardly so that the terminal is moved relatively into the cavity. The housing in turn pushes the jaws 20 rightwardly during this portion of the cycle and the jaws 20 are opened by virtue of the fact that they are moved rightwardly over the camming surfaces 122,122'. The rightward movement of the jaws 20 causes the rod 112 and the cylinder 138 to be moved rightwardly to the position of FIG. 25. During this portion of the cycle, the jaws 18 are opened by exhausting the pressure from the cylinder (FIG. 17) so that the spring 104 can move the jaws apart. The jaws 18,20 are then moved downwardly after the parts have reached the positions of FIG. 25 as previously explained and as shown in FIG. 8.

Figure 25:
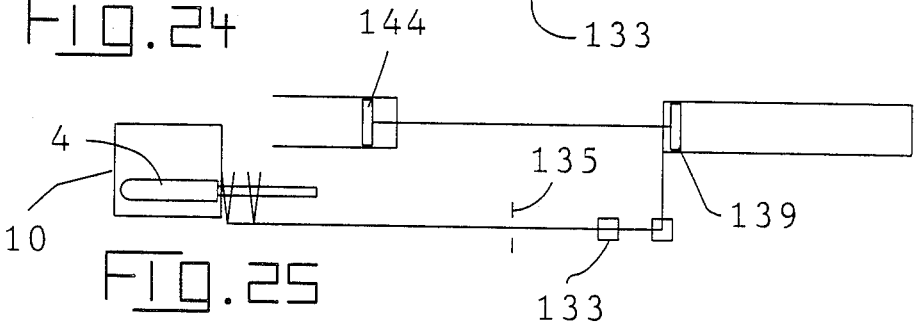

The pull test which is conducted to ensure complete insertion of the terminal is conducted immediately prior to the time the parts reach the positions shown in FIG. 25. This test is conducted as follows: after the housing has been moved by the robot rightwardly from the position of FIG. 24 a distance sufficient to cause the terminal to be fully inserted, the robot causes the housing to be moved leftwardly for a very short distance. If the terminal is fully inserted, the lance 8 will engage the shoulder 16 in the cavity 14 and a slight tension will be imposed on the wire. At this stage, the wire will be gripped by the jaws 18 and the jaws will be pivoted through a slight arc with respect to the pivotal axis 154. This arcuate movement will be detected by the sensor 158 and the control system will cause the pressure to be exhausted from the cylinder 86 thereby allowing the spring 104 to open the jaws 18 and release their grip on the wire. Thereafter, both sets of jaws are lowered.

A sensor 164 (FIG. 10) is provided to determine when the jaw assembly 51 is in its forward position (FIG. 10) rather than in its retracted position. This sensor is mounted on plate by means of a bracket as shown in FIG. 10 and detects movement of a vane or arm 162 which extends from a plunger 165. The plunger is supported by bearings 166,169 and is biased rightwardly as viewed in FIG. 10 by a spring 168 which bears against a collar on the plunger. When the jaw assembly is moved from its retracted position to its forward position, the enlarged head 161 of a screw, which is part of jaw assembly 51, engages the arm 162 and moves it with respect to the sensor. When the movement of the arm is detected, the sensor sends a signal to the control system to proceed with the subsequent steps of the insertion process.

An inserting apparatus in accordance with the invention is extremely versatile in that it can be used with a wide variety of harness making or lead making machines and under other circumstances where harnesses are manufactured. The disclosed embodiment is shown as being mounted adjacent to the unloading end of a conveyer 170, FIG. 14. Conveyers of the type shown comprise a pair of belts 172, 174 which are side-by-side and which have feeding courses that are against each other. As the belts are indexed, the electrical leads are delivered to a lead pickup station. The ends 172 of the belts constitute the lead pickup station for the apparatus. The disclosed embodiment is also shown with portions of a robot arm 178, FIG. 12, which has gripping arms 180 by means of which the connector housing is held. The robot or other device used for holding the connector can take any suitable form. A fully programmable versatile robot device is highly desirable in that the connector housing can be indexed by a small amount during each operating cycle so that each of the cavities in the housing can be located in alignment with a terminal presented to it by the insertion apparatus.

The apparatus, the robot, and the conveyer are preferably controlled by a suitable microprocessor. Sensors, in addition to the sensors 158,164 described above, can be provided to ensure that none of the operations or movements in the operating cycle take place until the previous operations have been completed. For example, sensor can be provided to sense the movement of the mounting block 54, the arcuate movement of the entire jaw assembly 51, and the indexing of the conveyer 170. All of the sensors are connected to the control system so that the apparatus will be stopped in the event of a malfunction.

I claim:

1. A terminal inserting means for inserting an electrical terminal into a terminal receiving cavity in an electrical connector housing, the housing having a terminal receiving face, the cavity extending inwardly from the terminal receiving face, the terminal being on one end of an electrical conductor, the conductor and the terminal constituting an electrical lead, the inserting means being characterized in that:

the terminal inserting means comprises terminal aligning means for aligning the terminal with the cavity and a terminal inserter for moving the terminal into the cavity, the terminal inserter comprising a first set of jaws, the terminal aligning means comprising a second set of jaws, the first and second sets of jaws being normally open and being normally in aligned, side-by-side, juxtaposed positions, the second set of jaws being between the first set of jaws and the cavity into which the terminal is to be inserted, the first and second sets of jaws being movable between their juxtaposed positions and extended positions in which the jaws are in aligned, spaced-apart relationship, the first and second sets of jaws are closable upon a lead located between the jaws of each set of jaws, the first set of jaws being in gripping engagement with the lead when in their closed positions, the second set of jaws being in surrounding and non-gripping relationship with the terminal when in their closed positions, actuating means are provided for closing the first and second sets of jaws, moving the second set of jaws to their extended position, and thereafter moving the first set of jaws relatively towards the second set of jaws and relatively towards the connector housing whereby, upon placing a lead between the jaws of each set of jaws and placing a connector housing adjacent to the lead with the cavity in approximate alignment with the lead, and upon closing the first and second sets of jaws and moving the second set of jaws to the extended position, the terminal will be precisely aligned with the cavity, and upon thereafter moving the first set of jaws relatively towards the second set of jaws and relatively towards the connector housing, the terminal will be inserted into the cavity, the second set of jaws serving as a terminal guide during insertion.

2. A terminal inserting means as set forth in claim 1 characterized in that the actuating means moves the first set of jaws towards the second set of jaws and towards the connector housing during insertion of the terminal into the cavity.

3. A terminal inserting means as set forth in claim 1 characterized in that the actuating means moves the connector housing towards the first set of jaws during insertion of the terminal into the cavity.

4. A terminal inserting means as set forth in claim 1 characterized in that a connector housing holding means is provided for holding a connector housing adjacent to the inserting means.

5. A terminal inserting means as set forth in claim 4 characterized in that the insertion means is intended to insert terminals into a connector housing having a plurality of terminal receiving cavities extending into its terminal receiving face, the terminal holding means having means for indexing the connector housing parallel to the place of the terminal receiving face thereby to position each of the cavities in approximate alignment with a lead located between the jaws of both sets of jaws.

6. A terminal inserting means as set forth in claim 5 characterized in that the connector holding means comprises a robot arm, the actuating means having means for indexing the robot arm thereby to index the connector housing.

7. A terminal inserting means as set forth in claim 1 characterized in that a lead delivery means is provided for delivering a succession of leads to a lead receiving zone, a lead positioned in the lead receiving zone being between the jaws of both sets of jaws when the jaws are in their normal positions.

8. A terminal inserting means as set forth in claim 7 characterized in that the lead delivery means comprises a lead conveyer.

9. A terminal inserting means as set forth in claim 7 characterized in that a connector holding means is provided for holding a connector housing adjacent to the inserting means.

10. A terminal inserting means as set forth in claim 9 characterized in that the inserting means is intended to insert terminals into a connector housing having a plurality of terminal receiving cavities extending into its terminal receiving face, the terminal holding means having means for indexing the connector housing parallel to the plane of the terminal receiving face thereby to position each of the cavities in approximate alignment with a lead located between the jaws of both sets of jaws.

11. A terminal inserting means as set forth in claim 10 characterized in that the connector holding means comprises a robot arm, the actuating means having means for indexing the robot arm.

12. A terminal inserting means as set forth in claim 1 characterized in that the inserting means is intended to insert terminals of the type having a retaining lance which is engageable with a retaining shoulder in the cavity thereby to prevent movement of the terminal from the cavity after insertion, the actuating means having means for moving the connector housing and the first set of jaws relatively away from each other after insertion of the terminal thereby to engage the retaining lance with the shoulder and ensure complete insertion of the terminal into the cavity, and sensing means are provided for sensing complete insertion of the terminal into the cavity.

13. A terminal insertion means as set forth in claim 4 characterized in that a lead receiving zone is provided which is angularly offset from the connector housing holding means, and means are provided for delivering an electrical lead to the lead receiving zone, the first and second sets of jaws being between the lead receiving zone and the connector housing holding means, the actuating means comprising jaw positioning means for moving the first and second sets of jaws between a loading position and a terminal inserting position, the first and second sets of jaws being positioned to receive a lead in the lead receiving zone when in the lead receiving position and being positioned to insert the terminal on the lead into the cavity in the connector housing when in the terminal inserting position.

14. A terminal inserting means as set forth in claim 13 characterized in that the jaw positioning means comprises means for pivotally moving the first and second sets of jaws between the lead receiving position and the terminal inserting position.

15. An assembling apparatus for assembling electrical leads to an electrical connector housing, each of the leads comprising a conductor having a terminal on one end thereof, the housing having a terminal receiving face and having terminal receiving cavities extending inwardly from the terminal receiving face, the apparatus comprising a connector loading zone and connector positioning means for positioning the connector in the loading zone, a lead receiving zone which is adjacent to, and spaced from, the terminal receiving face of a connector held in the connector loading zone, lead delivering means for delivering leads to the lead receiving zone, aligning means for aligning a terminal on a lead in the lead receiving zone with a cavity in a connector in the loading zone, and a terminal inserter for moving the lead axially from the lead receiving zone relatively towards the terminal receiving face of the connector housing whereby the terminal is inserted into the cavity, the apparatus being characterized in that:

the terminal inserter comprises a first set of jaws and the aligning means comprises a second set of jaws, the first and second sets of jaws being normally open and being normally in aligned, side-by-side juxtaposed positions, the second set of jaws being between the first set of jaws and the terminal receiving face of a connector housing in the connector loading zone, the first and second sets of jaws being movable between their juxtaposed positions and extended positions in which the jaws are in aligned spaced-apart relationship, the first and second sets of jaws being closable upon a lead in the lead receiving zone, the first set of jaws being in gripping engagement with the lead when in their closed positions, the second set of jaws being in surrounding and non-gripping relationship with the terminal when in their closed positions, actuating means are provided for actuating the lead delivering means, thereby to deliver a lead to the lead receiving zone, for closing the first and second sets of jaws and moving the second set of jaws to its extended position, whereby the lead is gripped by the first set of jaws and the terminal will be precisely aligned with the cavity by the second set of jaws, and for thereafter moving the first set of jaws and the connector housing relatively towards each other whereby the terminal is inserted into the cavity.

16. An assembling apparatus as set forth in claim 15 characterized in that the actuating means moves the first set of jaws towards the second set of jaws and towards the connector housing during insertion of the terminal into the cavity.

17. An assembling apparatus as set forth in claim 15 characterized in that the actuating means moves the connector housing towards the first set of jaws during insertion of the terminal into the cavity.

18. An assembling apparatus as set forth in claim 15 characterized in that the apparatus is intended to insert terminals of the type having a retaining lance which is engageable with a retaining shoulder in the cavity thereby to retain the terminal in the cavity, the actuating means having means for moving the connector housing and the first set of jaws away from each other after insertion of the terminal thereby to engage the retaining lance with the shoulder and ensure complete insertion of the terminal, and sensing means are provided for stopping movement of the connector housing and the first set of jaws away from each other when the lance engages the shoulder.

19. An assembling apparatus as set forth in claim 15 characterized in that the lead receiving zone and the connector loading zone are angularly offset from each other, the actuating means comprising jaw positioning means for moving the first and second sets of jaws between a lead receiving position and a terminal inserting position.

20. An assembling apparatus as set forth in claim 19 characterized in that the jaw positioning means comprises means for pivotally moving the first and second sets of jaws between the lead receiving position and the terminal inserting position.

* * * * *